US008900107B2

(12) United States Patent
Motokawa et al.

(10) Patent No.: US 8,900,107 B2
(45) Date of Patent: Dec. 2, 2014

(54) CONDUCTIVE RUBBER MEMBER

(75) Inventors: Shinji Motokawa, Tokyo (JP); Naoki Hirakawa, Tokyo (JP)

(73) Assignee: Synztec Co., Ltd., Tokyo (JP)

( * ) Notice: Subject to any disclaimer, the term of this patent is extended or adjusted under 35 U.S.C. 154(b) by 846 days.

(21) Appl. No.: 12/675,846

(22) PCT Filed: Sep. 1, 2008

(86) PCT No.: PCT/JP2008/065701

§ 371 (c)(1),
(2), (4) Date: Mar. 1, 2010

(87) PCT Pub. No.: WO2009/028712

PCT Pub. Date: Mar. 5, 2009

(65) Prior Publication Data

US 2010/0222193 A1 Sep. 2, 2010

(30) Foreign Application Priority Data

Aug. 31, 2007 (JP) ..... 2007-227173

(51) Int. Cl.
*B05C 1/08* (2006.01)
*G03G 15/20* (2006.01)
*G03G 15/08* (2006.01)

(52) U.S. Cl.
CPC ..... *G03G 15/2057* (2013.01); *G03G 15/0818* (2013.01)
USPC ..... 492/18; 492/59

(58) Field of Classification Search
USPC ..... 524/495; 492/18, 59; 428/423.1; 399/176
See application file for complete search history.

(56) References Cited

U.S. PATENT DOCUMENTS

| | | | | |
|---|---|---|---|---|
| 4,958,193 | A * | 9/1990 | Nojima et al. | 399/286 |
| 4,994,319 | A * | 2/1991 | Nojima et al. | 428/335 |
| 5,693,447 | A * | 12/1997 | Takeyama et al. | 430/201 |
| 5,925,893 | A * | 7/1999 | Ishii et al. | 257/40 |
| 6,287,246 | B1 * | 9/2001 | Yoshii et al. | 492/59 |
| 6,372,349 | B1 | 4/2002 | Hisashi et al. | |
| 7,144,525 | B2 * | 12/2006 | Yoshikawa et al. | 252/500 |
| 7,638,196 | B2 * | 12/2009 | Hirakawa et al. | 428/413 |
| 2003/0212189 | A1 * | 11/2003 | Burrington et al. | 524/495 |
| 2005/0029693 | A1 | 2/2005 | Noda et al. | |
| 2005/0227089 | A1 | 10/2005 | Hirakawa et al. | |
| 2007/0110936 | A1 * | 5/2007 | Hirakawa et al. | 428/36.8 |

FOREIGN PATENT DOCUMENTS

| | | |
|---|---|---|
| EP | 1804140 | 7/2007 |
| JP | 11-052675 | 2/1999 |
| JP | 2001-106938 | 4/2001 |

(Continued)

OTHER PUBLICATIONS

International Search Report, PCT/JP2008/065701, Nov. 4, 2008.

(Continued)

*Primary Examiner* — Jacob Cigna
(74) *Attorney, Agent, or Firm* — Young & Thompson

(57) ABSTRACT

To provide a conductive rubber member which exhibits small variation in electrical resistance and a stable electrical resistance for a long period of time. The conductive rubber member include a conductive elastic layer formed of a rubber material which has been imparted with electrical conductivity, wherein the conductive elastic layer has a surface-treatment layer which has been produced through impregnating a surface portion of the conductive elastic layer with a surface-treating liquid containing an isocyanate compound and carbon black which has undergone dispersion treatment.

9 Claims, 3 Drawing Sheets

(56) References Cited

FOREIGN PATENT DOCUMENTS

| | | | |
|---|---|---|---|
| JP | 2003-202722 | | 7/2003 |
| JP | 2003-202750 | | 7/2003 |
| JP | 2003202750 | A * | 7/2003 |
| JP | 2004-251946 | | 9/2004 |
| JP | 3655364 | | 3/2005 |
| JP | 2007-164147 | | 6/2007 |

OTHER PUBLICATIONS

EP Supplementary Search Report dated Aug. 20, 2012, Application No. 08828787.5.

* cited by examiner

CONDUCTIVE RUBBER MEMBER

TECHNICAL FIELD

The present invention relates to a conductive rubber member particularly suitable for a conductive roller (e.g., a charge-imparting roller, an image-transfer roller, a development roller, a toner-supply roller, or a cleaning roller), a cleaning blade, a transfer belt, etc., for use in an image-forming apparatus such as an electrophotographic or toner-jet-type copying machine or printer.

BACKGROUND ART

Conductive rubber members for use in an image-forming apparatus such as an electrophotographic copying machine or printer are imparted with electrical conductivity (hereinafter referred to simply as conductivity) by use of a conductivity-imparting material such as carbon black. Such rubber members problematically exhibit variation and changes in electrical resistance. Such variation and changes in electrical resistance at the surface of a conductive rubber member result in defects in formed images such as white spots.

The present applicant previously proposed a development roller having an elastic layer which has been imparted with conductivity by carbon black, and a surface treatment layer which has been produced through treatment of the surface of the elastic layer with a surface-treating liquid containing isocyanate, wherein the electrical resistance of the surface treatment layer gradually lowers from the top surface to the interior (see Patent Document 1). In the development roller disclosed in Patent Document 1, the network structure of carbon black in the formed surface treatment layer is gradually broken from the top surface to the interior, whereby the electrical resistance of the surface treatment layer gradually lowers (i.e., resistance-gradient layer). By virtue of the thus-formed resistance-gradient layer, variation in electrical resistance is suppressed.

However, when such a surface treatment layer is produced by use of a surface-treating liquid containing no carbon black, the network structure of carbon black which was present in the elastic layer before the treatment is broken by impregnation with isocyanate, in some cases resulting in a electrical resistance higher than a desired level. In the case where the surface treatment layer is produced by use of a surface-treating liquid containing carbon black, a uniform network structure of carbon black cannot be produced from the surface-treating liquid, in some cases causing variation in electrical resistance.

Patent Document 1:

Japanese Patent Application Laid-Open (kokai) No. 2003-202750

DISCLOSURE OF THE INVENTION

Problems to be Solved by the Invention

In view of the foregoing, an object of the present invention is to provide a conductive rubber member which exhibits small variation in electrical resistance and a stable electrical resistance for a long period of time.

SUMMARY OF THE INVENTION

Accordingly, in a first mode of the present invention for attaining the above object, there is provided a conductive rubber member, including a conductive elastic layer formed of a rubber material which has been imparted with electrical conductivity, characterized in that the conductive elastic layer has a surface-treatment layer which has been produced through impregnating a surface portion of the conductive elastic layer with a surface-treating liquid containing an isocyanate compound and carbon black which has undergone dispersion treatment.

A second mode of the present invention is drawn to a specific embodiment of the conductive rubber member according to the first mode, wherein the dispersion treatment is performed by use of a dispersant or an acid/alkali.

A third mode of the present invention is drawn to a specific embodiment of the conductive rubber member according to the first mode, wherein the dispersant is at least one member selected from a polymer dispersant and a surfactant.

A fourth mode of the present invention is drawn to a specific embodiment of the conductive rubber member according to any of the first to third modes, wherein the ratio ($R_{max}/R_{min}$) of the maximum electrical resistance value ($R_{max}$) to the minimum electrical resistance value ($R_{min}$) is less than 5, wherein the electrical resistance of the conductive member is measured at a voltage of 100 V and under a load falling within a range of 100 g to 500 g.

A fifth mode of the present invention is drawn to a specific embodiment of the conductive rubber member according to any of the first to fourth modes, wherein the ratio ($R_{max}/R_{min}$) of the maximum electrical resistance value ($R_{max}$) to the minimum electrical resistance value ($R_{min}$) is less than 5, wherein the electrical resistance is measured at an application voltage of 100 V and under a load falling within a range of 100 g to 500 g.

A sixth mode of the present invention is drawn to a specific embodiment of the conductive rubber member according to any of the first to fifth modes, wherein the conductive rubber member is in the form of a roller, blade, or belt.

Effects of the Invention

According to the present invention, a conductive elastic layer is impregnated with a surface-treating liquid containing carbon black which has undergone dispersion treatment and an isocyanate compound, to thereby produce a surface-treatment layer. The isocyanate compound and carbon black which has undergone dispersion treatment are introduced to the interior of the conductive elastic layer, whereby conduction paths attributed to carbon black are gradually broken from the top surface of a surface portion to the interior of the conductive elastic layer and uniform conduction paths are newly formed. Thus, the conductive rubber member of the invention exhibits small variation in electrical resistance, and attains stable electrical resistance for a long period of time.

DESCRIPTION OF REFERENCE NUMERALS

10: Conductive roller
11: Metal shaft
12: Conductive elastic layer
12A: Conductivity-imparting agent

12*a*: Conduction path
13: Surface-treatment layer
13A: Carbon black
13*a*: Conduction path
13B: Isocyanate compound

DETAILED DESCRIPTION OF THE INVENTION

The conductive rubber member of the present invention includes a conductive elastic layer formed of a rubber material which has been imparted with electrical conductivity, wherein the conductive elastic layer has a surface-treatment layer which has been produced through impregnating a surface portion of the conductive elastic layer with a surface-treating liquid containing an isocyanate compound and carbon black which has undergone dispersion treatment. The isocyanate compound and carbon black which has undergone dispersion treatment are introduced to the interior of the conductive elastic layer, whereby conduction paths attributed to carbon black are gradually broken from the top surface of a surface portion to the interior of the conductive elastic layer and uniform conduction paths are newly formed.

Figure 1:
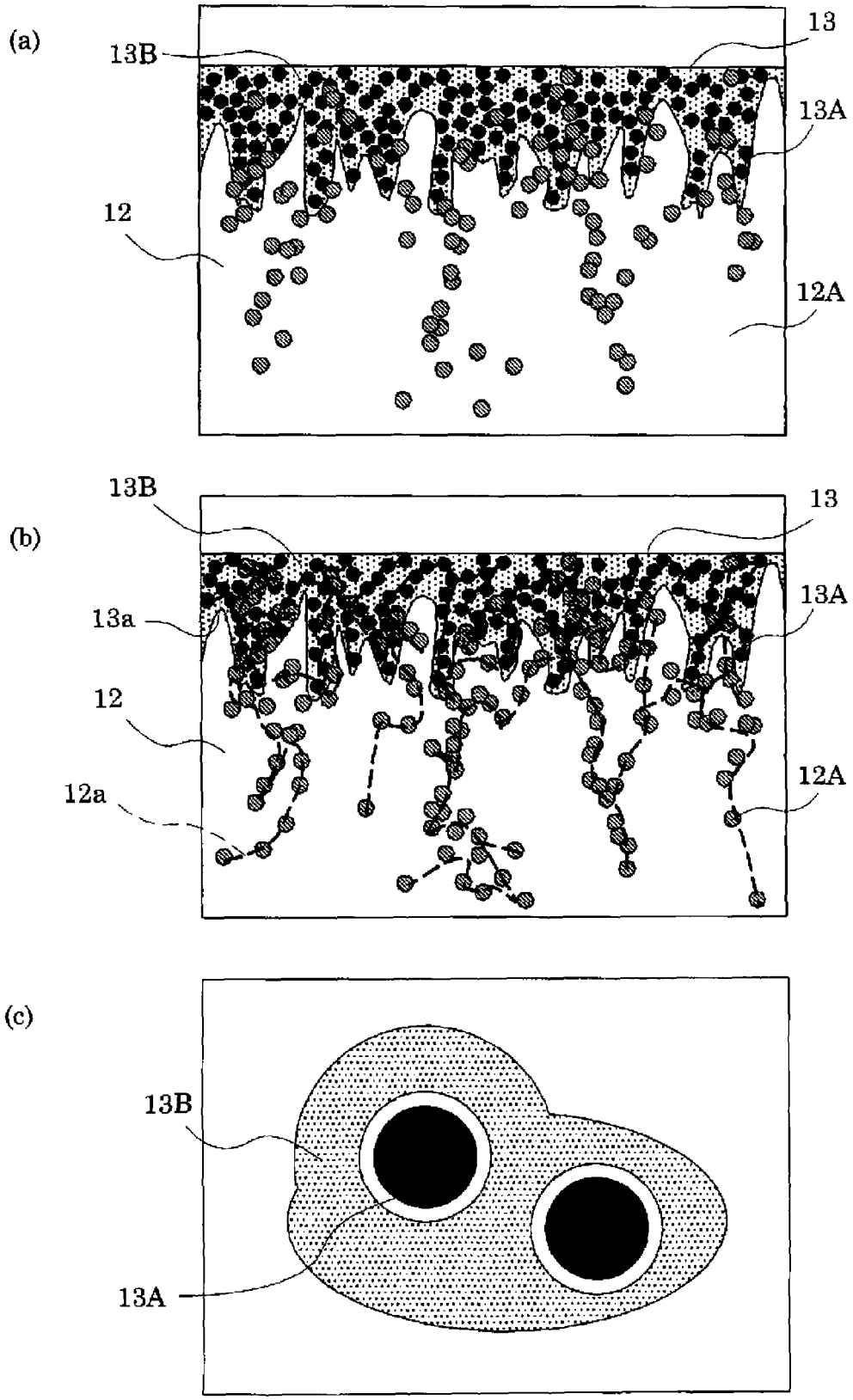
FIG. 1 Sketches of a surface portion of the conductive rubber member of the present invention.

With reference to FIG. 1, the conductive rubber member of the invention will be described in detail. FIG. 1 schematically shows a surface portion of the conductive rubber member of the present invention.

The surface-treating liquid of the present invention contains at least carbon black which has undergone dispersion treatment, an isocyanate compound, and an organic solvent. As used herein, the "dispersion treatment" refers to a treatment for enhancing dispersibility of carbon black in the surface-treating liquid and, more specifically, for enhancing dispersibility not only in the organic solvent contained in the surface-treating liquid but also in the isocyanate compound. In other words, the dispersion treatment is a treatment for enhancing dispersibility of carbon black in the solvent as well as for enhancing affinity of carbon black to the isocyanate compound and dispersibility of carbon black in the isocyanate compound. The carbon black which has undergone the dispersion treatment is prevented from aggregating as observed for conventional non-treated carbon black, and is uniformly dispersed in the isocyanate compound and in the organic solvent.

As shown in FIG. 1(*a*), when a conductive elastic layer is impregnated with the surface-treating liquid, a surface portion of the conductive elastic layer 12 swells by the organic solvent contained in the surface-treating liquid. Chains of a conductivity-imparting agent 12A present in the conductive elastic layer 12 are broken from the top surface to the interior of the surface portion, and the broken portions are uniformly filled with an isocyanate compound 13B and carbon black 13A. In this case, as shown in FIG. 1(*c*), the carbon black 13A which has undergone dispersion treatment has high affinity to the isocyanate compound 13B, whereby aggregation of particles of carbon black 13A is prevented. Therefore, the surface portion (surface-treatment layer 13) of the conductive rubber member of the present invention is impregnated with the isocyanate compound 13B and the carbon black 13A, while the carbon black 13A is uniformly dispersed in the isocyanate compound 13B. This feature differs from that of a surface portion (surface-treatment layer) of a conductive rubber member produced by use of a conventional surface-treating liquid containing carbon black which has not undergone dispersion treatment.

As a result, as shown in FIG. 1(*b*), the surface portion of the conductive elastic layer 12 of the present invention is provided with conduction paths 12*a* attributed to the conductivity-imparting agent 12A, and conduction paths 13*a* attributed to carbon black 13B contained in the surface-treating liquid. Differing from a conventional surface portion, conduction paths 13*a* are not localized but are formed uniformly in the surface portion. The density of the conduction paths (12*a* and 13*a*) in the conductive elastic layer 12 is higher at the top surface, whereby a resistance-gradient layer is realized in the surface portion.

The conduction paths 13*a* is uniformly formed from non-aggregated carbon black 13A in the surface portion. Therefore, the conductive rubber member of the present invention exhibits small variation in electrical resistance without causing local increase or decrease in electrical resistance. Preferably, the conductive rubber member also exhibits a ratio ($R_{max}/R_{min}$) of the maximum electrical resistance value ($R_{max}$) to the minimum electrical resistance value ($R_{min}$) of less than 5, the electrical resistance being measured at an application voltage of 100 V, after 10,000 paper-feeding operations.

Since carbon black 13A that has undergone dispersion treatment is not aggregated and is uniformly dispersed in the isocyanate compound 13B, the carbon black readily enters the interior of the conductive elastic layer 12. Thus, the surface portion (surface-treatment layer 13) of the conductive rubber member of the present invention can have conduction paths 13*a* to the interior, in contrast to a surface portion (surface-treatment layer 13) which is produced through impregnation with a conventional surface-treating liquid containing non-treated carbon black. Therefore, the conductive rubber member of the present invention can suppress variation in surface resistance, which would otherwise be caused by deformation of the rubber member during operation, and attains stable electrical resistance for a long period of time. Preferably, the conductive rubber member also exhibits a ratio ($R_{max}/R_{min}$) of the maximum electrical resistance value ($R_{max}$) to the minimum electrical resistance value ($R_{min}$) of less than 5, the electrical resistance being measured at an application voltage of 100 V under a load falling within a range of 100 g to 500 g.

The conductive rubber member which has been produced by use of a surface-treating liquid containing carbon black that has undergone dispersion treatment does not cause a considerable drop in electrical resistance, which would otherwise be caused by an increase in the amount of added carbon black. In other words, the conductive rubber member of the present invention easily attains an electrical resistance value of interest.

As described above, the surface-treating liquid employed in the present invention contains at least carbon black which has undergone dispersion treatment, an isocyanate compound, and an organic solvent.

No particular limitation is imposed on the type of carbon black, and carbon black generally employed as a conductivity-imparting agent for conductive rollers or the like may be used. Examples of the carbon black include channel black, furnace black, Ketjen black, and acetylene black. These carbon black products may be used singly or in combination of two or more species. No particular limitation is imposed on the mean primary particle size of carbon black. From the viewpoint of dispersibility in the surface-treating liquid, the mean primary particle size is preferably about 5 to about 200 nm, more preferably about 10 to about 100 nm.

Examples of the mode of dispersion treatment of carbon black include a treatment with a dispersant and a treatment with an acid/alkali. Both treatments may be performed.

Examples of the dispersant include dispersants generally employed as polymer dispersants, and surfactants. These dispersants may be used singly or in combination. These dispersants preferably have an electron-donating atom (e.g., nitrogen or oxygen) or a basic functional group (e.g., amino group or imido group), since such dispersants have excellent affinity to isocyanate compounds. The dispersant preferably has a number average molecular weight of 500 to 100,000, more preferably 500 to 50,000, particularly preferably 500 to 10,000. Through the above limitation on the number average molecular weight of the dispersant, carbon black which has undergone dispersion treatment is more readily introduced to the interior of the conductive elastic layer. When the number average molecular weight is in excess of 100,000, impregnation, with carbon black, of the interior of the conductive elastic layer is impeded, which not preferred.

The polymer dispersant employed in the invention may be a thermoplastic resin dispersant or thermosetting resin dispersant. Examples of the thermosetting resin include urethane resin, acrylic resin, polyimide resin, alkyd resin, epoxy resin, unsaturated polyester resin, melamine resin, and phenolic resin. Examples of the thermoplastic resin include acrylic resin, vinyl chloride resin, vinyl chloride-vinyl acetate copolymer resin, urethane reins, polyamide resin, and polycarbonate resin.

Among the thermosetting resin dispersants or the thermoplastic resin dispersants, polyurethane resin dispersants are particularly preferred, since polyurethane has higher affinity to isocyanate compounds. As used herein, the term "polyurethane resin" refers to a polymer compound having urethane bonds in the backbone thereof, for example, a reaction product between a diisocyanate compound and a diol compound.

Also, preferably employed is a polyethylene glycol-polypropylene glycol monomethacrylate, which is a copolymer of hydrophilic polyethylene oxide and oleophilic polypropylene oxide, since the polymer has excellent affinity to isocyanate compounds and high dispersibility. Through selecting the polymerization degree, the affinity of polyethylene glycol-polypropylene glycol monomethacrylate can be controlled with respect to some isocyanate compounds. Examples of the polyethylene glycol-polypropylene glycol monomethacrylate include Blemmer PEP series (products of Nippon Oil & Fats Co., Ltd.) and Blemmer AEP series (products of Nippon Oil & Fats Co., Ltd.).

The surfactant may be any of an ampholytic surfactant, a cationic surfactant, an anionic surfactant, and a nonionic surfactant. Of these, a nonionic surfactant and an anionic surfactant are preferred, since wettability of carbon black can be enhanced, thereby attaining more enhanced dispersibility and dispersion stability.

Examples of the nonionic surfactant include polyoxyethylene alkyl ethers, polyoxyethylene alkylaryl ethers, polyoxyethylene derivatives, polyoxyethylene-oxypropylene block copolymer, sorbitan fatty acid esters, polyoxyethylene sorbitan fatty acid esters, polyoxyethylene sorbitol fatty acid esters, glycerin fatty acid esters, polyoxyethylene fatty acid esters, acetylenediol, polyoxyethylene alklyamine, silicone surfactants such as silicone modified with polyoxyethylene alkylphenyl ether, and fluorine-containing surfactants.

Examples of the anionic surfactant include fatty acid salts, alkyl sulfate ester salts, alkylarylsulfonate salts, alkylnaphthalenesulfonate salts, dialkylsulfonate salts, dialkylsulfosuccinate salts, alkyl diaryl ether disulfonate salts, alkylphosphate salts, polyoxyethylene alkylaryl ether sulfate salts, naphthalenesulfonic acid-formalin condensates, polyoxyethylene alkylphosphate ester salts, glycerol borate fatty acid esters, and polyoxyethylene glycerol fatty acid esters.

No particular limitation is imposed on the treatment method employing a dispersant. In one method, carbon black, the aforementioned dispersant, a dispersion medium (organic solvent), etc. in appropriate amounts are mixed together, and the mixture stirred at about 5 to about 70° C. for about 1 to about 50 hours, whereby carbon black is subjected to dispersion treatment in the dispersion medium, to thereby yield the dispersion-treated carbon black. In another method, carbon black, a dispersant, a dispersion medium (organic solvent), an isocyanate compound, etc. are mixed together, and the mixture is stirred, to thereby produce a surface-treating liquid containing the dispersion-treated carbon black and the isocyanate compound.

The aforementioned treatment of carbon black with an acid/alkali means performing at least one of an acid treatment and an alkali treatment. Needless to say, both an acid treatment and an alkali treatment may be performed. Examples of the acid treatment include air-oxidation in which carbon black is brought into contact with air in a high temperature atmosphere; reaction with nitrogen oxide or ozone at ambient temperature; air-oxidation at high temperature and subsequent ozone oxidation at low temperature; and liquid phase oxidation in which carbon black is immersed in an acid solution such as nitric acid or hydrogen peroxide. Examples of the alkali treatment include an immersion method in which carbon black is immersed in an alkali solution such as sodium hydroxide or amine. Of these, the alkali treatment is preferred, from the viewpoint of affinity to an isocyanate compound. Therefore, when both an acid treatment and an alkali treatment are performed, the alkali treatment is preferably performed after the acid treatment.

When the dispersion treatment of carbon black includes both a treatment with a dispersant and a treatment with an acid/alkali, the dispersant is preferably added after treatment of carbon black with the acid/alkali, since the acid/alkali treatment enhances the affinity of carbon black to the dispersant and the dispersibility of carbon black in the dispersant.

Examples of the isocyanate compound include isocyanate compounds such as 2,6-tolylene diisocyanate (TDI), 4,4'-diphenylmethane diisocyanate (MDI), p-phenylene diisocyanate (PPDI), 1,5-naphthalene diisocyanate (NDI), and 3,3-dimethyldiphenyl-4,4'-diisocyanate (TODI); the aforementioned oligomers and modified products thereof; and prepolymers formed from polyol and isocyanate.

The surface-treating liquid may further contain at least one polymer selected from among an acrylic fluoropolymer, an acrylic silicone polymer, and a polyether-type polymer.

Preferably, the polyether-type polymer is soluble in organic solvent and/or has active hydrogen, which reacts with an isocyanate compound to form a chemical bond. More preferably, the polyether-type polymer has a hydroxyl group, and examples of such polymers include polyols and glycols. The polyether-type polymer preferably has an allyl group. The polyether-type polymer preferably has a number average molecular weight of 300 to 1,000, from the viewpoint of imparting the surface-treatment layer with elasticity. The polyether is preferably of a single-end type rather than of a both-end type.

Examples of such polyether-type polymers include polyalkylene glycol menomethyl ether, polyalkylene glycol dimethyl ether, allylated polyether, polyalkylene glycol diol, and polyalkylene glycol triol.

Through addition of the polyether-type polymer to the surface-treating liquid, the produced surface-treatment layer has enhanced softness and strength, whereby wearing of the surface of a conductive rubber member and damage to the surface of a photoreceptor which the rubber member contacted are prevented.

The acrylic fluoropolymer or acrylic silicone polymer employed in the surface-treating liquid is soluble in a specific solvent and reacts with an isocyanate compound to form a chemical bond. An example of the acrylic fluoropolymer is a solvent-soluble fluorine-containing acrylic polymer having a hydroxyl group, an alkyl group, or a carboxyl group, and specific examples thereof include a block copolymer of an acrylate ester and a fluoroalkyl acrylate and derivatives of the block copolymer. The acrylic silicone polymer is a silicone polymer which is soluble in solvent. Specific examples thereof include a block copolymer of an acrylate ester and a siloxane acrylate ester and derivatives of the block copolymer.

Preferably, the surface-treating liquid contains an acrylic fluoropolymer and an acrylic silicone polymer in a total amount (with respect to 100 parts by mass of isocyanate compound) of 2 to 30 parts by mass (unless otherwise specified the unit "part(s) by mass" is referred to simply as "part(s)"). When the total amount is less than 2 parts, retention of carbon black or the like in the surface-treatment layer decreases, whereas when the total polymer amount is excessive, the electrical resistance of the charge-imparting roller increases, to thereby impair electric discharge characteristics. In addition, the relative amount of isocyanate compound decreases, thereby failing to produce an effective surface-treatment layer.

No particular limitation is imposed on the organic solvent, so long as the solvent can dissolve isocyanate compounds. Preferably, the organic solvent has high affinity to the dispersant. Examples of such organic solvents include ethyl acetate, methyl ethyl ketone (MEK), and toluene.

Before dispersion treatment, the amount of carbon black employed in the surface-treating liquid is preferably 55 mass % or less, with respect to the isocyanate compound. An excessive carbon black amount is not preferred, since removal of carbon black, impairment in physical properties of the rubber member, etc. occur, and the electrical resistance is likely to increase.

The conductive elastic layer is formed by blending a rubber material with a conductivity-imparting agent, to thereby attain electrical conductivity. The rubber material may be selected in accordance with the use thereof, and examples include polyurethane, epichlorohydrin rubber, acrylonitrile-butadiene rubber (NBR), chloroprene rubber (CR), styrene rubber (SBR), and blends thereof.

Examples of the conductivity-imparting agent include carbon black, an electron-conductivity-imparting agent such as metallic powder, an ion-conductivity-imparting agent, and mixtures thereof. Of these, carbon black is preferred. No particular limitation is imposed on the type of carbon black, and examples thereof include Ketjen black, Toka black, furnace black, and acetylene black. Examples of the ion-conductivity-imparting agent include an organic salt, an inorganic salt, a metal complex, and an ionic liquid. Examples of the organic salt and inorganic salt include lithium perchlorate, a quaternary ammonium salt, and sodium trifluoroacetate. Examples of the metal complex include ferric halide-ethylene glycol. A more specific example is a diethylene glycol-ferric chloride complex disclosed in Japanese Patent No. 3655364. Meanwhile, ionic liquid, which is also called ambient temperature molten salt, is a molten salt which is in the liquid form at room temperature, having a melting point of 70° C. or lower, preferably 30° C. or lower. Specific examples of ionic liquid include 1-ethyl-3-methylimidazolium bis(trifluoromethylsulfonyl)imide and 1-butyl-3-ethylimidazolium (trifluoromethylsulfonyl)imide, which are disclosed in Japanese Patent Application Laid-Open (kokai) No. 2003-202722.

The conductive elastic body is formed by adding, to the aforementioned rubber material and a conductivity-imparting agent, an additive such as a vulcanizing agent, and heat-curing the mixture.

The conductive elastic layer is impregnated with the surface-treating liquid through any method, for example, a method in which the conductive elastic layer is immersed in the surface-treating liquid, or a method in which the surface-treating liquid is applied to the conductive elastic layer through spraying. The time of immersing the conductive elastic layer in the surface-treating liquid, the number of times of spraying, and the amount of the surface-treating liquid may be appropriately modified. After impregnation of the conductive elastic layer with the surface-treating liquid, the liquid is cured, to thereby produce a surface-treatment layer. Since surface-treatment layer is produced in a surface portion of the conductive elastic layer through impregnation with the surface-treating liquid and subsequent curing, the surface-treatment layer is integrated with the conductive elastic layer.

The conductive rubber member provided with such a surface-treatment layer prevents deposition of substances (e.g., a toner ingredient) thereon to a greatly enhanced degree. Furthermore, bleeding of a contamination substance which would otherwise bleeds from the interior of the conductive elastic layer to the surface thereof can be prevented to an enhanced degree. Thus, conductive rubber member of the invention effectively prevents staining of a photoreceptor or other members.

The conductive rubber member of the present invention is suitable for a conductive roller (e.g., a charge-imparting roller, an image-transfer roller, a development roller, a toner-supply roller, or a cleaning roller), a cleaning blade, a transfer belt, etc., for use in an image-forming apparatus such as an electrophotographic or toner-jet-type copying machine or printer.

The present invention will next be described in detail by way of examples, which are given for the illustration purpose and which should not be construed as limiting the invention thereto.

Example 1

Production of Conductive Elastic Layer

Epichlorohydrin rubber (Epichlomer CG-102, product of Daiso Co., Ltd.) (100 parts), sodium trifluoroacetate (0.3 parts) serving as a conducting agent, zinc oxide (ZnO) (5 parts), and 2-mercaptoimidazoline (Accel-22) serving as a vulcanizer (2 parts) were kneaded by means of a roll mixer, and the kneaded product was press-formed onto the surface of a metallic shaft (diam.: 6 mm). The outer surface of the thus-coated shaft was polished, to thereby adjust the outer diameter to 14 mm, to thereby form an epichlorohydrin rubber conductive elastic layer on the surface of the shaft. Thus, an untreated roller 1 was produced.

<Dispersion Treatment of Carbon Black>

Acetylene black (20 parts), polyethylene glycol-polypropylene glycol monomethacrylate (weight average molecular weight: 1,500) (denoted by "dispersant A1" in Table 1) (1.5 parts), and butyl acetate (78.5 parts) were mixed by means of a ball mill at 50° C. for three hours, to thereby produce a carbon black dispersion 1.

<Production of Surface-Treatment Layer>

Ethyl acetate (100 parts), 4,4'-diphenylmethane diisocyanate (MDI) (20 parts), and the carbon black dispersion 1 (25 parts) were mixed by means of a ball mill for three hours for dispersing carbon black, to thereby produce a surface-treating liquid. The untreated roller 1 was immersed for 30 seconds in the surface-treating liquid maintained at 23° C. and, subsequently, heated for one hour in an oven maintained at 120° C., to thereby produce a surface-treatment layer. Thus, a conductive roller of Example 1 was produced.

Example 2

The procedure of Example 1 was repeated, except that polyoxyethylene alkylamine (weight average molecular weight: 3,000) (denoted by "dispersant B" in Table 1) was used instead of polyethylene glycol-polypropylene glycol monomethacrylate (weight average molecular weight: 1,500), to thereby produce a conductive roller of Example 2.

Example 3

The procedure of Example 1 was repeated, except that acetylene black which had been undergone an alkali treatment in advance was used in the dispersion treatment of carbon black, to thereby produce a conductive roller of Example 3. In the alkali treatment, acetylene black was allowed to stand in 2M aqueous sodium hydroxide at 80° C. for 15 minutes, washed with water, and dried at 120° C. for four hours.

Example 4

The procedure of Example 1 was repeated, except that furnace black was used in the dispersion treatment of carbon black instead acetylene black, to thereby produce a conductive roller of Example 4.

Example 5

Production of Conductive Elastic Layer

Toka Black #5500 (product of Tokai Carbon Co., Ltd.) (4 parts) and VALCAN XC (product of Cabot) (3 parts) were added to a tri-functional polyether-polyol GP-3000 (product of Sanyo Chemical Industries, Ltd.) (100 parts) and dispersed in the polyol so that the particle size of carbon black is about 20 μm or less. After controlling the temperature of the dispersion to 80° C., the dispersion was dehydrated, to thereby produce liquid A.

Separately, Coronate C-HX (product of Nippon Polyurethane Industry Co., Ltd.) (11 parts) was added to a prepolymer (Adiprene L100, product of Uniroyal) (25 parts) with mixing, and the temperature of the mixture was adjusted to 80° C., to thereby prepare liquid B. Liquids A and B were mixed together, and a rubber roller was produced from the liquid mixture. The outer surface of the produced conductive roller was polished, to thereby adjust the outer diameter thereof to a predetermined value, thereby producing an untreated roller 2.

<Production of Surface-Treatment Layer>

Ethyl acetate (100 parts), 4,4'-diphenylmethane diisocyanate (MDI) (20 parts), and the carbon black dispersion 1 (25 parts) were mixed by means of a ball mill for three hours for dispersing carbon black, to thereby produce a surface-treating liquid. The untreated roller 2 was immersed for 30 seconds in the surface-treating liquid maintained at 23° C. and, subsequently, heated for one hour in an oven maintained at 120° C., to thereby produce a surface-treatment layer. Thus, a conductive roller of Example 5 was produced.

Example 6

The procedure of Example 1 was repeated, except that, in the dispersion treatment of carbon black, polyethylene glycol-polypropylene glycol monomethacrylate (weight average molecular weight: 12,000) (denoted by "dispersant A2" in Table 1) was used instead of polyethylene glycol-polypropylene glycol monomethacrylate (weight average molecular weight: 1,500), to thereby produce a conductive roller of Example 6.

Example 7

The procedure of Example 1 was repeated, except that, in the dispersion treatment of carbon black, polyethylene glycol-polypropylene glycol monomethacrylate (weight average molecular weight: 20,000) (denoted by "dispersant A3" in Table 1) was used instead of polyethylene glycol-polypropylene glycol monomethacrylate (weight average molecular weight: 1,500), to thereby produce a conductive roller of Example 7.

Example 8

The procedure of Example 5 was repeated, except that, in the dispersion treatment of carbon black, Ketjen black was used instead of acetylene black, and polyethylene glycol monoacrylate (weight average molecular weight: 3,000) (denoted by "dispersant C" in Table 1) was used instead of polyethylene glycol-polypropylene glycol monomethacrylate (weight average molecular weight: 1,500), to thereby produce a conductive roller of Example 8.

Example 9

Production of Conductive Elastic Layer

To an acrylonitrile-butadiene rubber (middle to high nitrile content) (70 parts) and epichlorohydrin rubber (Epichlomer CG-102, product of Daiso Co., Ltd.) (30 parts), Acetylene Black (product of Denki Kagaku Kogyo K.K.) serving as a conducting agent (5 parts), tetraethylammonium perchlorate (product of Kanto Kagaku) (1 part), factice (Brown PR; product of Tenma Factice Mfg. Co., Ltd.) (5 parts), Sanceler TET (product of Sanshin Chemical Ind. Co., Ltd.) (1.5 parts), Sanceler CZ (product of Sanshin Chemical Ind. Co., Ltd.) (1.5 parts), and sulfur (1.0 part) were added, and the mixture was kneaded by means of a roll mixer. The outer surface of a shaft coated with the kneaded product was polished, to thereby adjust the outer diameter to 14 mm, whereby an epichlorohydrin rubber conductive elastic layer was formed on the surface of the shaft. Thus, an untreated roller 3 was produced.

<Production of Surface-Treatment Layer>

Ethyl acetate (100 parts), 4,4'-diphenylmethane diisocyanate (MDI) (20 parts), acetylene black (5 parts), polyoxyethylene-polyoxypropylene-alkyl ether (weight average molecular weight: 3,000) (denoted by "dispersant D" in Table 1) (0.5 parts) were mixed by means of a ball mill for three hours for dispersing carbon black, to thereby produce a surface-treating liquid. The untreated roller 3 was immersed for 30 seconds in the surface-treating liquid maintained at 23° C. and, subsequently, heated for one hour in an oven maintained at 120° C., to thereby produce a surface-treatment layer. Thus, a conductive roller of Example 9 was produced.

Example 10

The procedure of Example 9 was repeated, except that Ketjen black which had been undergone an acid treatment and an alkali treatment was used in the production of a surface-treatment layer, to thereby produce a conductive roller of Example 10. In the above treatments, Ketjen black was allowed to stand in 2M nitric acid at 80° C. for 15 minutes, washed with water, and dried at 120° C. for four hours. The thus-treated Ketjen black was allowed to stand in 2M aqueous sodium hydroxide at 80° C. for 15 minutes, washed with water, and dried at 120° C. for four hours.

Comparative Example 1

Ethyl acetate (100 parts), 4,4'-diphenylmethane diisocyanate (MDI) (20 parts), and untreated acetylene black (5 parts) were mixed by means of a ball mill for three hours for dispersing carbon black, to thereby produce a surface-treating liquid. The untreated roller 1 was immersed for 30 seconds in the surface-treating liquid maintained at 23° C. and, subsequently, heated for one hour in an oven maintained at 120° C., to thereby produce a surface-treatment layer. Thus, a conductive roller of Comparative Example 1 was produced.

Comparative Example 2

The procedure of Example 8 was repeated, except that polyethylene glycol monoacrylate (weight average molecular weight: 3,000) was not used, to thereby produce a conductive roller of Comparative Example 2.

Comparative Example 3

Formation of Coating Layer

The procedure of Example 8 was repeated, except that a urethane coating (NeoRez R-940, product of Kusumoto Chemicals, Ltd.) was added instead of 4,4'-diphenylmethane diisocyanate (MDI) (20 parts), to thereby prepare a treatment liquid and form a 30-μm coating layer. The thus-produced conductive roller was employed as a conductive roller of Comparative Example 3.

Comparative Example 4

The procedure of Example 9 was repeated, except that polyoxyethylene-polyoxypropylene-alkyl ether (weight average molecular weight: 3,000) was not used, to thereby produce a conductive roller of Comparative Example 4.

Test Example 1

Measurement of Electrical Resistance

Figure 2:
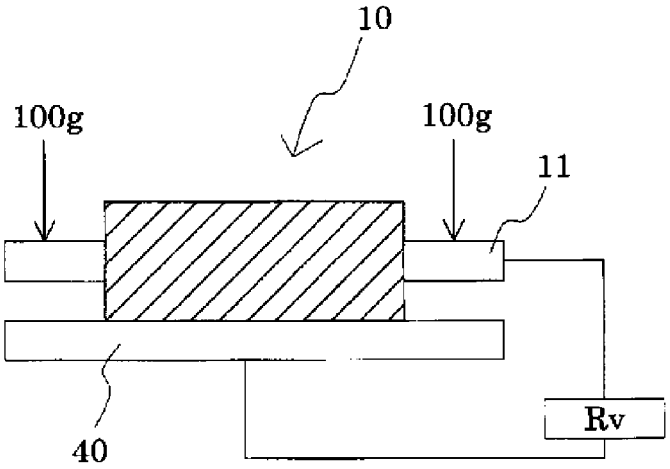
FIG. 2 A sketch showing the measurement method employed in Test Example 1.

Variation in electrical resistance of each of the conductive rollers of the Examples and Conductive Examples was evaluated in the axial direction and the circumferential direction. As shown in FIG. 2, a stainless steel electrode 51 having a width of 2 mm was brought into contact with the surface of a rubber elastic layer 12 of the conductive roller, while the roller was rotated about a metallic core 11. The measurement was performed at six different positions in the longitudinal direction. The average electrical resistance of the roller was calculated. The ratio ($R_{max}/R_{min}$) of the maximum electrical resistance value ($R_{max}$) to the minimum electrical resistance value ($R_{min}$) was employed as indexes for evaluating variation in electrical resistance. The results are shown in Table 1.

Test Example 2

Image Evaluation

Each of the conductive rollers of the Examples and Comparative Examples was installed as a charge-imparting roller in a commercial laser printer (LP-8600FX: product of EPSON). Images were output by operating the laser printer under the conditions of 10° C. and 20% RH (LL) and 30° C. and 85% RH (HH), and the quality of the output images was evaluated on the basis of the following ratings: excellent (O), fair (Δ), and poor (X). The rating "poor" refers to an image in which unevenness in color density, deterioration, etc. were observed. The results are also shown in Table 1.

Test Example 3

Continuous Printing Test

Each of the conductive rollers of the Examples and Comparative Examples was installed as a charge-imparting roller in a commercial laser printer (LP-8600FX: product of EPSON). After 10,000 continuous printing operations under HH conditions (35° C. and 85% RH) had been completed, new printed images were evaluated on the basis of the following ratings: excellent (O), fair (Δ), and poor (X). The rating "poor" refers to an image in which unevenness in color density, deterioration, etc. were observed. The results are also shown in Table 1.

Test Example 4

Dependency of Resistance of Roller on Load Applied to the Roller

Figure 3:
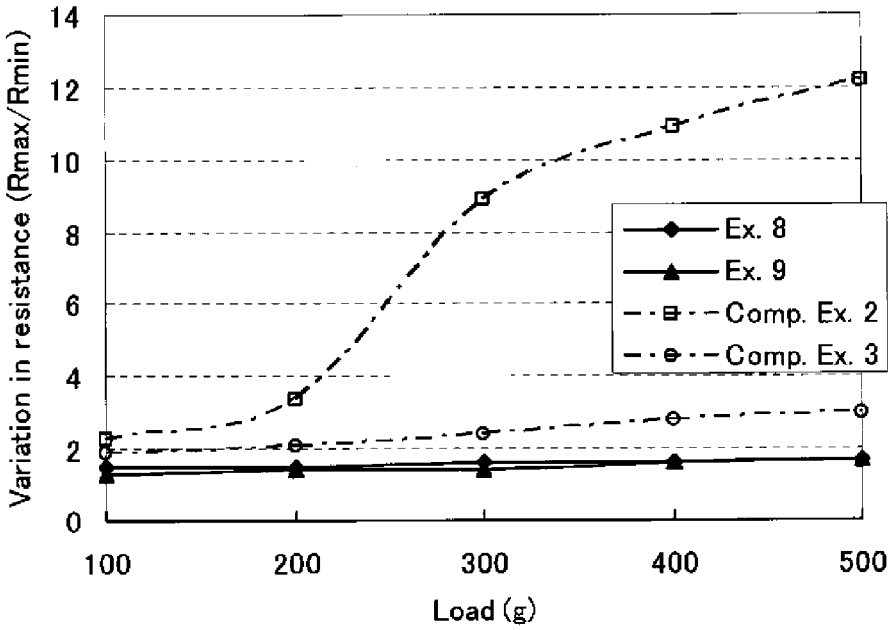
FIG. 3 A graph showing the results of Test Example 4.

The electrical resistance of each of the conductive rollers of Example 8 and 9 and Comparative Example 2 and 3 was measured under a load of 100 g, 200 g, 300 g, 400 g, and 500 g. Specifically, under NN conditions (23° C., 55% RH), the conductive roller was placed on an electrode member formed of a SUS 304 plate, and a predetermined load was applied to each end of a metal shaft of the roller. In this state, a voltage of 100 V was applied for 30 seconds, and electrical resistance between the metal shaft and the electrode member was measured by means of ULTRA HIGH RESISTANCE METER R8340A (product of Advan Test). While the roller was stepwise rotated in the circumferential direction by 45°, the electrical resistance was measured at eight points, whereby the ratio of maximum resistance to minimum resistance ($R_{max}/R_{min}$) was calculated. The results are shown in Table 2 and FIG. 3. The roller of Example 9 which was subjected to electrical resistance measurement was produced from isocyanate (20 parts) and carbon black (11 parts).

Test Example 5

Figure 4:
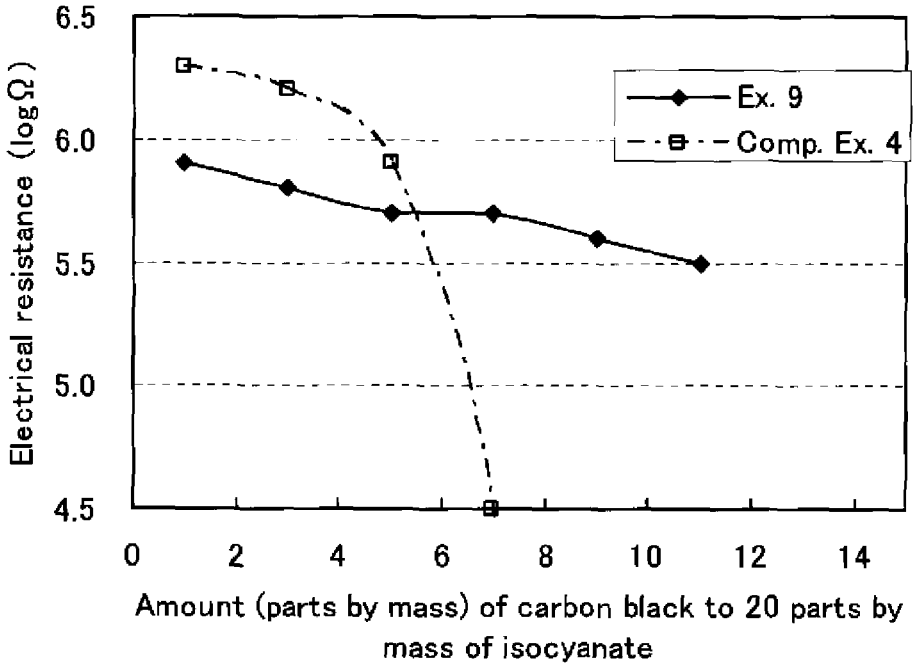
FIG. 4 A graph showing the results of Test Example 5.

Dependency of Resistance of Roller on the Amount of Carbon Black Added to the Roller The electrical resistance of each of the rollers of Example 9 and Comparative Example 4 was measured, while the amount of carbon black with respect to 20 parts of isocyanate was varied among 1, 3, 5, 7, 9, and 11 parts. The same method as employed in Test Example 4 was employed for measuring electrical resistance. The average of electrical resistance values was calculated. The electrical resistance was measured under a load of 100 g. The results are shown in Table 3 and FIG. 4.

TABLE 1

| | Carbon black | Rubber material | Dispersant | Mol. wt. of dispersant | Other treatment | Image evaluation init. | Image evaluation 10k prints | Resistance logΩ init. | Resistance logΩ 10k prints | Variation in resistance ($R_{max}/R_{min}$) init. | Variation in resistance ($R_{max}/R_{min}$) 10k prints |
|---|---|---|---|---|---|---|---|---|---|---|---|
| Ex. 1 | Acetylene black | Epichlo | dispersant A1 | 1,500 | — | ○ | ○ | 6.1 | 6.3 | 1.8 | 2.1 |
| Ex. 2 | Acetylene black | Epichlo | dispersant B | 3,000 | — | ○ | ○ | 5.8 | 6.2 | 1.7 | 1.9 |
| Ex. 3 | Acetylene black | Epichlo | dispersant A1 | 1,500 | alkali | ○ | ○ | 7.2 | 7.4 | 1.6 | 2.2 |
| Ex. 4 | Furnace black | Epichlo | dispersant A1 | 1,500 | — | ○ | ○ | 5.9 | 6.2 | 1.9 | 2.3 |
| Ex. 5 | Acetylene black | Urethane | dispersant A1 | 1,500 | — | ○ | ○ | 7.2 | 7.3 | 1.8 | 2.2 |
| Ex. 6 | Acetylene black | Epichlo | dispersant A2 | 12,000 | — | ○ | Δ | 7.5 | 8.4 | 2.8 | 3.2 |
| Ex. 7 | Acetylene black | Epichlo | dispersant A3 | 20,000 | — | ○ | Δ | 7.8 | 8.5 | 2.5 | 3.9 |
| Ex. 8 | Ketjen black | Urethane | dispersant C | 3,000 | — | ○ | ○ | 7.5 | 7.7 | 1.6 | 1.8 |
| Ex. 9 | Ketjen black | NBR/ Epichlo | dispersant D | 3,000 | — | ○ | ○ | 5.5 | 6.0 | 1.8 | 2.2 |
| Ex. 10 | Ketjen black | NBR/ Epichlo | — | — | acid/ alkali | ○ | ○ | 6.5 | 6.8 | 1.6 | 1.7 |
| Comp. Ex. 1 | Acetylene black | Epichlo | — | — | — | ○ | X | 8.0 | 9.1 | 2.4 | 15.2 |
| Comp. Ex. 2 | Ketjen black | Urethane | — | — | — | ○ | X | 7.6 | 9.1 | 2.5 | 20.3 |
| Comp. Ex. 3 | Ketjen black | Urethane | dispersant C | 3,000 | — | ○ | X | 7.8 | 9.5 | 1.9 | 40.5 |
| Comp. Ex. 4 | Ketjen black | NBR/ Epichlo | — | — | — | ○ | X | 6.0 | 8.9 | 1.8 | 32.7 |

TABLE 2

| | Load | Ex. 8 | Ex. 9 | Comp. Ex. 2 | Comp. Ex. 3 |
|---|---|---|---|---|---|
| Variation in resistance ($R_{max}/R_{min}$) | 100 g | 1.5 | 1.3 | 2.3 | 1.9 |
| | 200 g | 1.5 | 1.4 | 3.4 | 2.1 |
| | 300 g | 1.6 | 1.4 | 8.9 | 2.4 |
| | 400 g | 1.6 | 1.6 | 10.9 | 2.8 |
| | 500 g | 1.7 | 1.7 | 12.2 | 3.0 |

TABLE 3

| | Amount | Ex. 9 | Comp. Ex. 4 |
|---|---|---|---|
| Resistance (logΩ) | 1 part | 5.9 | 6.3 |
| | 3 parts | 5.8 | 6.2 |
| | 5 parts | 5.7 | 5.9 |
| | 7 parts | 5.7 | 4.5 |
| | 9 parts | 5.6 | N.D. |
| | 11 parts | 5.5 | N.D. |

Results

The conductive rollers of Examples 1 to 5, 8, and 9, produced by use of carbon black that had undergone a treatment with a dispersant having a number average molecular weight of 3,000 or less, provided high-quality images even after completion of 10,000 paper-feeding operations. The conductive rollers of Examples 1 to 5, 8, and 9 exhibited a small variation in electrical resistance of 2.3 or less, after completion of 10,000 paper-feeding operations. The conductive rollers of Examples 6 and 7, produced by use of carbon black that had undergone a treatment with a dispersant having a number average molecular weight of 12,000 or more, provided fair-quality (i.e., acceptable) images even after completion of 10,000 paper-feeding operations, and exhibited small variation in electrical resistance. The conductive rollers of Example 10, produced by use of carbon black that had undergone an acid/alkali treatment, provided high-quality images and exhibited small variation in electrical resistance.

In contrast, the conductive roller of Comparative Example 1, produced by use of untreated carbon black, exhibited an electrical resistance higher than that of the conductive rollers of Examples 1 to 7, possibly because conduction paths were not satisfactorily formed due to a poor dispersion state of carbon black. Also, the electrical resistance after completion of 10,000 paper-feeding operations increased, and the variation in electrical resistance was large. Similarly, the conductive rollers of Comparative Example 2 and 4, produced by use of untreated carbon black, exhibited an electrical resistance higher than that of the conductive rollers of Examples 8 and 9, possibly because conduction paths were not satisfactorily formed due to a poor dispersion state of carbon black. Also, the variation in electrical resistance after completion of 10,000 paper-feeding operations was large.

The dependency of electrical resistance on the load was confirmed for the conductive rollers of Examples 8 and 9 and Comparative Examples 2 and 3. The conductive rollers of Examples 8 and 9 exhibited small variation in electrical resistance in terms of the load, but the conductive roller of Comparative Example 2 exhibited large variation in electrical resistance in terms of the load. The conductive roller of Comparative Example 3, in which the coating layer was formed by use of carbon black that had undergone a treatment with a dispersant, exhibited small dependency of electrical resistance on the load, but exhibited large variation in electrical resistance after completion of 10,000 paper-feeding operations, and cracks were observed on the surface thereof.

Therefore, a conductive rubber member including a conductive elastic layer formed of a rubber material which has been imparted with electrical conductivity, wherein the conductive elastic layer has a surface-treatment layer which has been produced through impregnating a surface portion of the conductive elastic layer with a surface-treating liquid containing an isocyanate compound and carbon black which has undergone dispersion treatment was found to exhibit small variation in electrical resistance and provide a stable electrical resistance for a long period of time.

The dependency of electrical resistance on the amount of added carbon black was confirmed for the conductive roller of Example 9. As the amount of carbon black increased, the electrical resistance gradually lowered. In the case where the amount of carbon was adjusted to 11 parts, variation in electrical resistance in terms of the load was small.

In contrast, when the dependency of electrical resistance on the amount of added carbon was confirmed for the roller of Comparative Example 4, a drastic drop in electrical resistance (i.e., percolation) was observed by changing the amount of carbon from 5 parts to 7 parts. Note that, when the amount of carbon was adjusted to 9 parts and 11 parts, the electrical resistance could not be measured due to the measurement limit.

Therefore, when the amount of carbon black that had undergone dispersion treatment was increased, the electrical resistance of the conductive roller was not drastically lowered, whereby the electrical resistance of the conductive roller can be readily controlled to a value of interest. In addition, when the amount of carbon black increased, the electrical resistance of the conductive roller was not drastically lowered by virtue of the added dispersant. Therefore, the electrical resistance of the conductive roller can be readily controlled to a value of interest.

The invention claimed is:

1. A conductive rubber member comprising a conductive elastic layer formed of a rubber material that has been imparted with electrical conductivity, the conductive elastic layer having a surface-treatment layer comprising carbon black and an isocyanate compound that has been produced through impregnating a surface portion of the conductive elastic layer with a surface-treating liquid, the liquid comprising:

the isocyanate compound, and pre-treated carbon black that has undergone dispersion pre-treatment with a polymer dispersant, prior to being included in the surface-treating liquid, wherein the density of conductive paths in the conductive elastic layer is higher at the surface of the conductive elastic layer than an interior, thus forming a resistance gradient in the conductive elastic layer, and wherein the carbon black has undergone dispersion pre-treatment only with the polymer dispersant, and the polymer dispersant comprises a polyethylene glycol-polypropylene glycol monomethacrylate.

2. The conductive rubber member according to claim 1, wherein the ratio (Rmax/Rmin) of the maximum electrical resistance value (Rmax) to the minimum electrical resistance value (Rmin) is less than 5, the electrical resistance of the conductive member being measured at a voltage of 100 V and after completion of 10,000 paper-feeding operations.

3. The conductive rubber member according to claim 1, in the form of a roller, a blade, or a belt.

4. The conductive rubber member according to claim 1, wherein the isocyanate compound comprises one or more of 2,6-tolylene diisocyanate (TDI), 4,4'-diphenylmethane diisocyanate (MDI), p-phenylene diisocyanate (PPDI), 1,5-naphthalene diisocyanate (NDI), or 3,3-dimethyldiphenyl-4,4'-diisocyanate (TODI).

5. The conductive rubber member according to claim 1, wherein the ratio (Rmax/Rmin) of a maximum electrical resistance value (Rmax) to a minimum electrical resistance value (Rmin) is less than 5, the electrical resistance being measured at a voltage of 100 V and under a load falling within a range of 100 g to 500 g.

6. The conductive rubber member according to claim 1, wherein the polyethylene glycol-polypropylene glycol monomethacrylate has a weight average molecular weight of about 1,500 to 20,000.

7. A conductive rubber member comprising a conductive elastic layer formed of a rubber material that has been imparted with electrical conductivity, the conductive elastic layer having a surface-treatment layer comprising carbon black and an isocyanate compound that has been produced through impregnating a surface portion of the conductive elastic layer with a surface-treating liquid, the liquid comprising:

the isocyanate compound, and pre-treated carbon black that has undergone dispersion pre-treatment with a non-ionic surfactant, prior to being included in the surface-treating liquid, wherein the density of conductive paths in the conductive elastic layer is higher at the surface of the conductive elastic layer than an interior, thus forming a resistance gradient in the conductive elastic layer, and wherein the carbon black has undergone dispersion pre-treatment only with the non-ionic surfactant, and the non-ionic surfactant is selected from the group consisting of: a polyoxyethylene alkylamine, a polyethylene glycol monoacrylate, polyoxyethylene-polyoxypropylene-alkyl ether, or a mixture thereof.

8. The conductive rubber member according to claim 7, wherein the non-ionic surfactant has a weight average molecular weight of about 3,000.

9. The conductive rubber member according to claim 7, in the form of a roller, a blade, or a belt.

* * * * *